US009475081B1

(12) United States Patent
Ellis

(10) Patent No.: US 9,475,081 B1
(45) Date of Patent: Oct. 25, 2016

(54) LIQUID APPLICATION SYSTEM FOR A FLEXIBLE WEB

(71) Applicant: Michael A. Ellis, Dalton, GA (US)

(72) Inventor: Michael A. Ellis, Dalton, GA (US)

( * ) Notice: Subject to any disclaimer, the term of this patent is extended or adjusted under 35 U.S.C. 154(b) by 276 days.

(21) Appl. No.: 14/494,481

(22) Filed: Sep. 23, 2014

(51) Int. Cl.
*B05C 1/04* (2006.01)
*B05C 1/08* (2006.01)

(52) U.S. Cl.
CPC ..... *B05C 1/0826* (2013.01)

(58) Field of Classification Search
None
See application file for complete search history.

(56) References Cited

U.S. PATENT DOCUMENTS 2,884,893 A * 5/1959 Kabelitz ..... D06B 3/10 118/33
4,791,004 A * 12/1988 Suzuki ..... B05D 1/305 118/600
5,149,372 A * 9/1992 Ives ..... B29B 15/122 118/407
2004/0007175 A1* 1/2004 Levendusky ..... B05D 1/265 118/641
2006/0177591 A1* 8/2006 Raday ..... B29B 15/122 427/430.1
2011/0239935 A1* 10/2011 Salazar ..... B05C 1/0865 118/641

* cited by examiner

*Primary Examiner* — Charles Capozzi
(74) *Attorney, Agent, or Firm* — Quickpatents, LLC; Kevin Prince

(57) ABSTRACT

An applicator device applies at least one liquid to a first side of a flexible web, such as a web of carpet material. A pair of application stations each comprises at least a pair of parallel rollers each driven by a roller motor arrangement. A platen directs the web between the rollers. Two dams are each laterally adjustable with respect to a top roller and conform to the shape of the top roller at a forward end thereof. Each of the dams, the top roller, and the web define a puddle area to which one of the at least one liquid is applied for application to the web as the web moves between the pair of rollers. A rigid frame fixes a first application station in a substantially horizontal orientation, and a second of the application stations in a substantially vertical orientation, with a turning roller situated therebetween.

6 Claims, 5 Drawing Sheets

LIQUID APPLICATION SYSTEM FOR A FLEXIBLE WEB

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to applicators, and more particularly to a system to apply a liquid to a flexible web.

DISCUSSION OF RELATED ART

Machines that apply a liquid, such as a polymer or adhesive, to a web such as a length of carpet material are known in the art. Such prior art devices only adequately apply the liquid to the web, and achieve only adequate results in terms of penetration depth into the web and what are known as tuftbind and bundle wrap performance tests.

Therefore, there is a need for a device that not only increases the performance in tuftbind and bundle wrap tests of treated carpets, but that also provides the option of applying a second liquid to an opposing side of the web if desired, all in one web-handling station. The present invention accomplishes these objectives.

SUMMARY OF THE INVENTION

The present device applies at least one liquid to a first side of a flexible web, such as a web of carpet material, for example. The applicator device includes a pair of application stations that each comprises at least a pair of parallel rollers adapted to receive the flexible web therebetween.

Each roller is driven by a roller motor arrangement. A platen is fixed adjacent to an inlet side of the pair of rollers and is situated to direct the web between the rollers. Two dams are each laterally adjustable with respect to a top roller of the pair of rollers and are adapted to conform to the shape of the top roller at a forward end thereof. Each of the dams, the top roller, and the web define a puddle area to which one of the at least one liquid is applied for application to the web as the web moves between the pair of rollers. Preferably each dam further includes an automated lateral position adjustment mechanism that includes a web edge sensor that provides positioning information to a motorized position adjustment mechanism for adjusting each dam, such that the dam is automatically positioned proximate one of the edges of the web.

Preferably each roller is substantially hollow and adapted to receive a cooling fluid therethrough from an inlet port on a first end thereof, to an outlet port on a second end thereof. As such each roller resists adhesion of the at least one liquid thereto.

A turning roller is situated between each of the application stations. A rigid frame fixes a first application station in a substantially horizontal orientation, and a second of the application stations in a substantially vertical orientation. The turning roller is generally above the second application station and to the rear of the first application station. The frame further includes at least a base for supporting the application device on a ground surface.

Each top roller is preferably mounted to the frame with a pneumatic cylinder controlled by a load cell that detects pressure between the web and the top roller. As such, a precise pressure may be applied to the web by the rollers.

The rollers of the second application station may be set to rotate more quickly than the rollers of the first application station, such that the liquid on the top side of the web is forced deeper into the web when passing through the second application station and rollers thereof.

As such, the flexible web enters the first application station to receive one of the at least one liquids applied thereto on the first side thereof, turns substantially -degrees at the turning roller, and enters the second application station to optionally receive one of the at least one liquid applied to a second side thereof.

The present invention increases the performance in tuftbind and bundle wrap tests of treated carpets, and also provides the option of applying a second liquid to an opposing side of the web if desired, all in one web-handling station. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
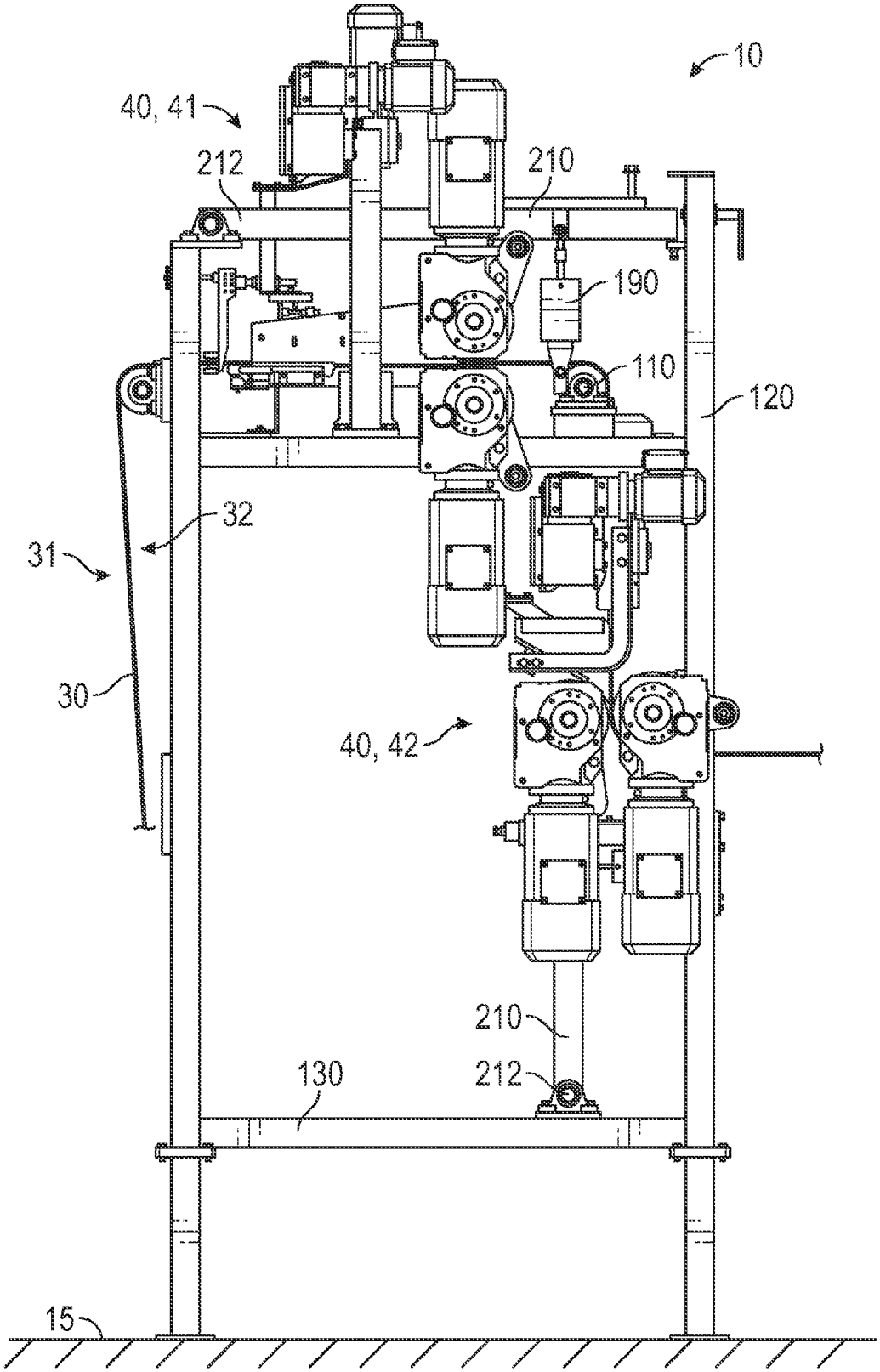
FIG. 1 is a side elevational view of the invention as resting on a ground surface.
Figure 2:
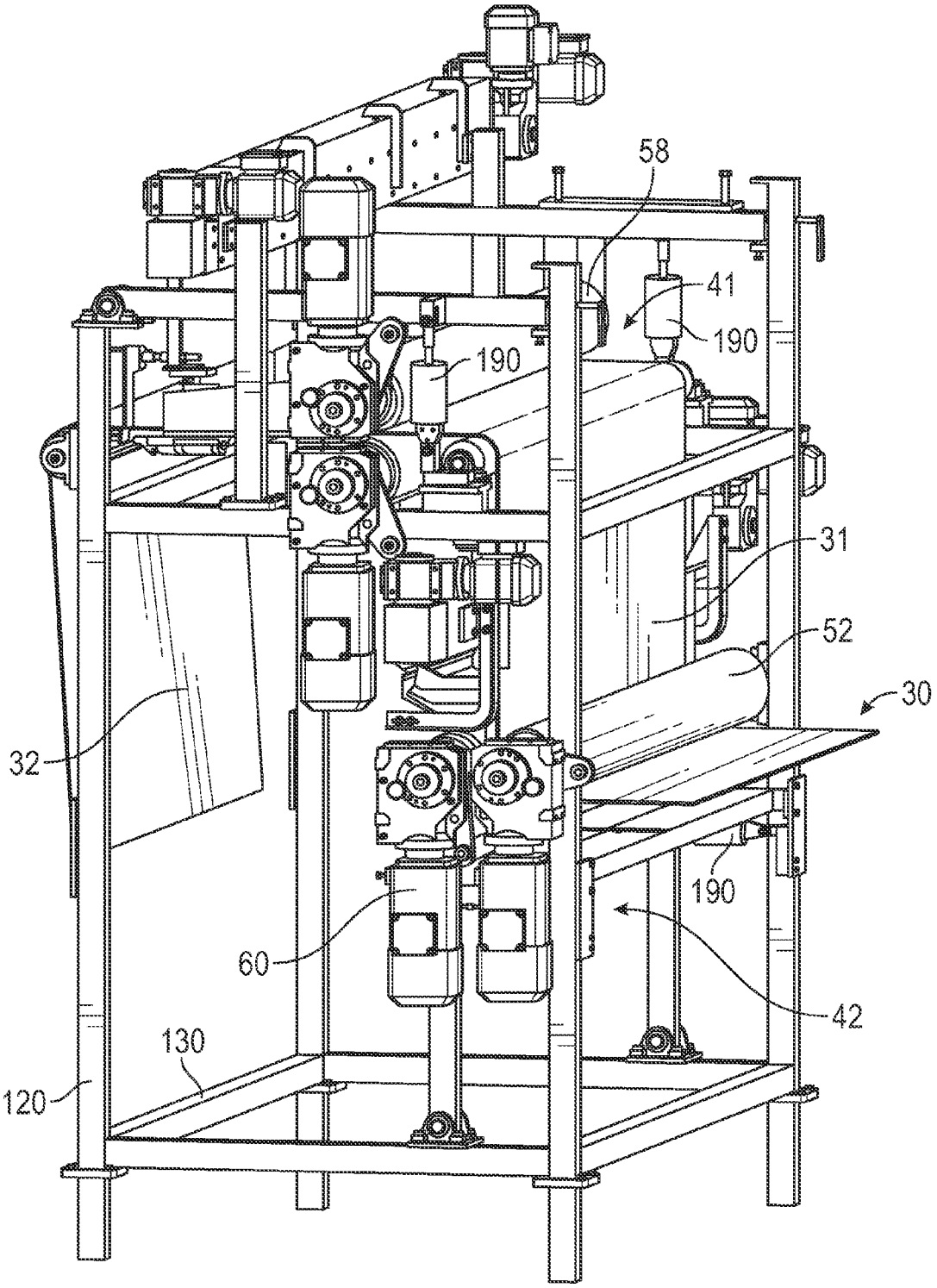
FIG. 2 is a perspective view of the invention.

FIGS. 1 and 2 illustrate an application device 10 for applying at least one liquid 20 to a first side 31 of a flexible web 30, such as a web 30 of carpet material, for example. Such a liquid 20 is preferably a liquid latex, polymer or chemical treatment, preferably having a viscosity of around 5,000 centipoise (CPS). Such a web 30 is preferably delivered to the applicator device 10 from a roll (not shown), another web-handling machine (not shown), or the like. After the at least one liquid 20 is applied to the web 30, the web 30 is preferably received from the applicator device 10 on a receiving roll (not shown), other web-handling machine (not shown), or the like.

The applicator device 10 includes a pair of application stations 40 that each comprises at least a pair of parallel rollers 50 adapted to receive the flexible web 30 therebetween. The web 30 fits within a separation distance D between the parallel rollers 50 that is adjustable as discussed below.

Each roller 50 is driven by a roller motor arrangement 60. A platen 70 is fixed adjacent to an inlet side 80 of the pair of rollers 50 and is situated to direct the web 30 between the rollers 50. Two dams 90 are each laterally adjustable with respect to a top roller 58 of the pair of rollers 50 and are adapted to conform to the shape of the top roller 58 at a forward end 57 thereof. Each of the dams 90, the top roller 58, and the web 30 define a puddle area 100 to which one of the at least one liquid 20 is applied for application to the web 30 as the web 30 moves between the pair of rollers 50.

Figure 5:
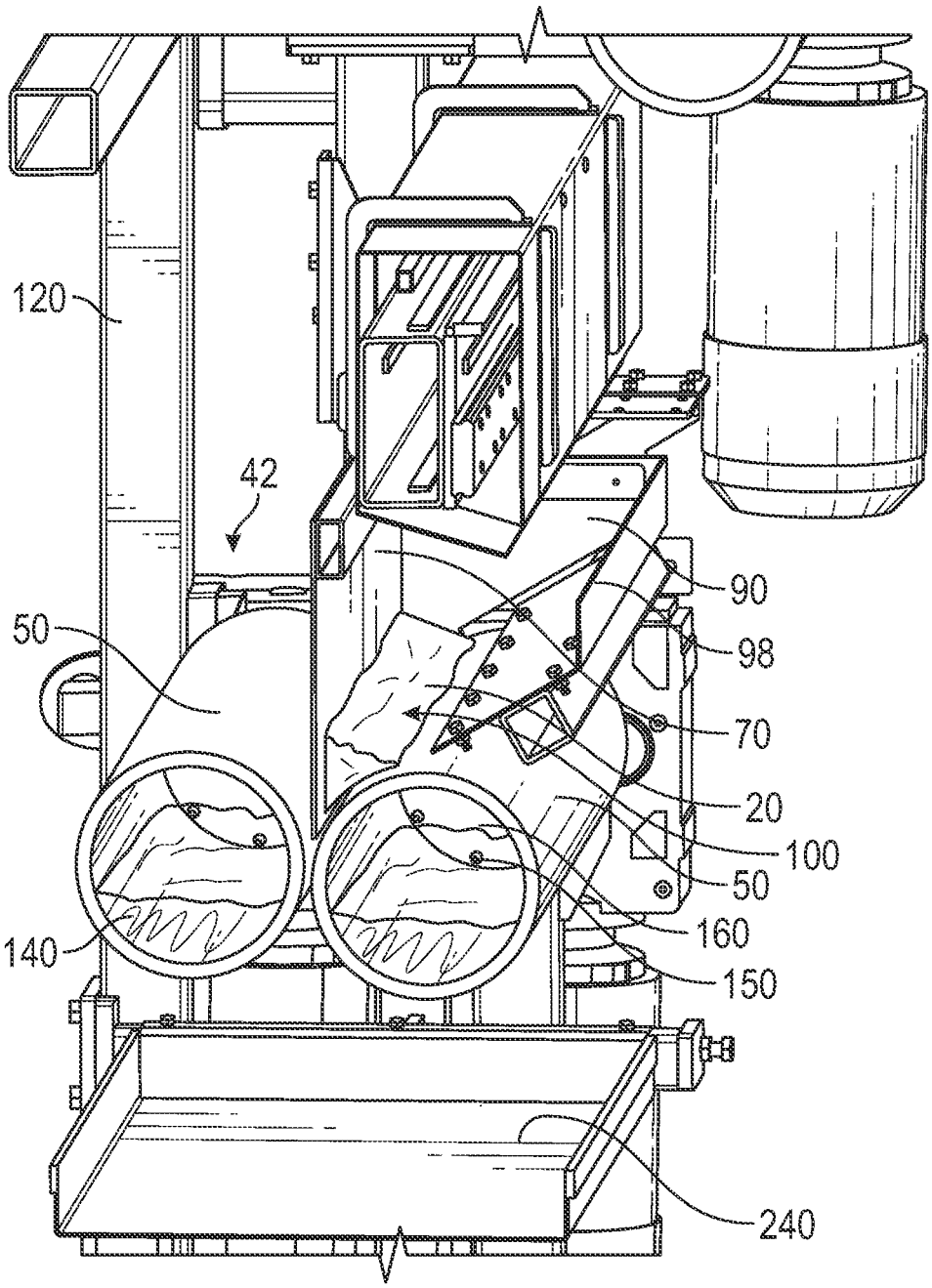
FIG. 5 is a cross-sectional view of the invention, taken across a pair of the rollers of a second of the application stations.

Preferably each roller 50 is substantially hollow and adapted to receive a cooling fluid 140 therethrough from an inlet port 150 on a first end 160 thereof, to an outlet port 170 on a second end 165 thereof (FIG. 5). Preferably each port 150,170 includes a rotary joint with a built-in conduit, as is known in the art. A cooling fluid 140, such as water, may then traverse through the roller 150. As such each roller 150 resists adhesion of the at least one liquid 20 thereto.

Figure 4:
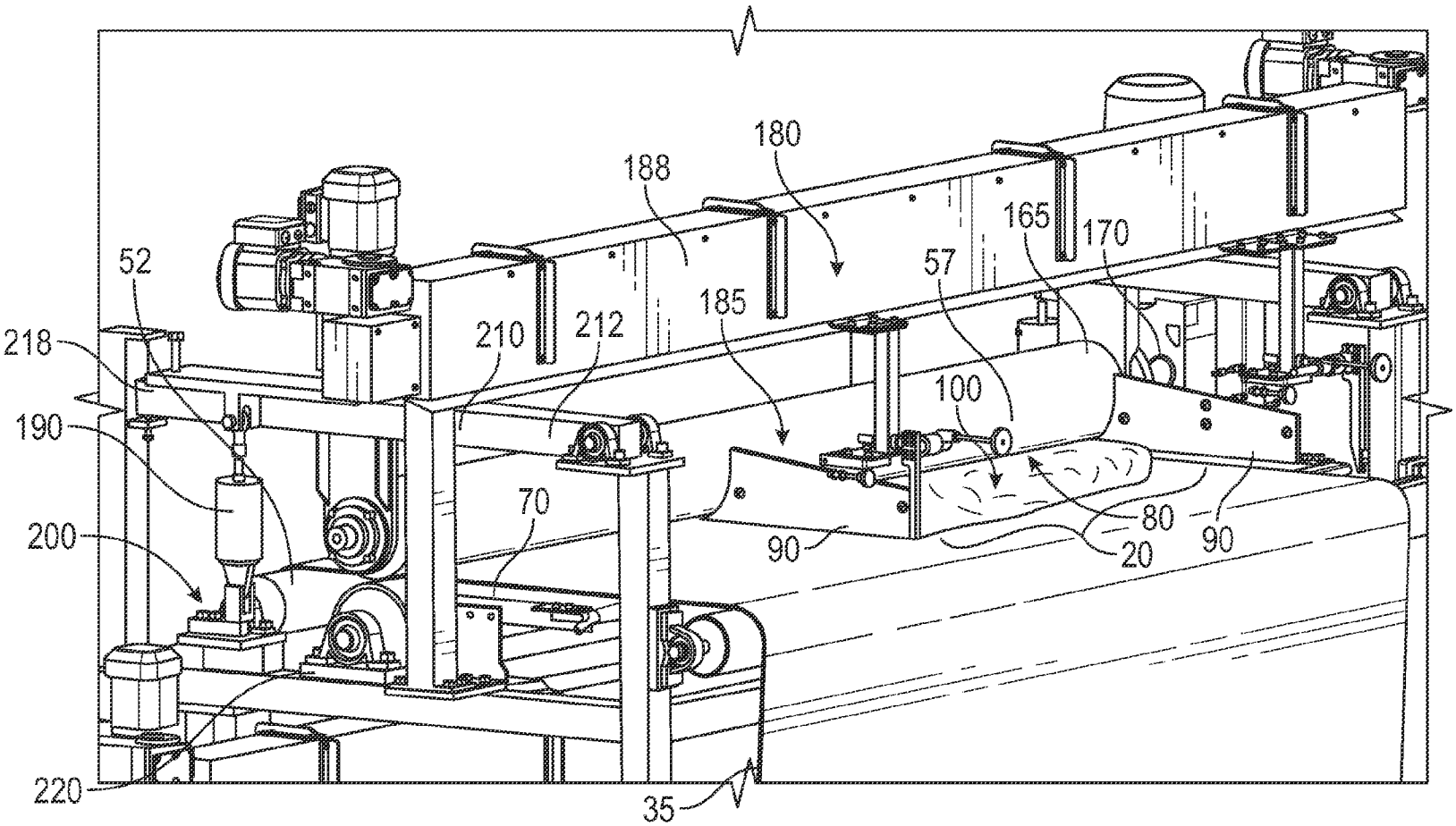
FIG. 4 is a partial perspective view of the invention, illustrating a pair of laterally-adjustable dams and a pneumatic cylinder adapted to apply a variable pressure to a top roller of one of the application stations of the invention.

Preferably each dam 90 further includes an automated lateral position adjustment mechanism 180 (FIG. 4) that includes a web edge sensor 185 that provides positioning information to a motorized position adjustment mechanism 188 for adjusting each dam 90, such that the dam 90 is automatically positioned proximate one of the edges 35 of the web 30. The second application station 42 may further include a rear dam 98 (FIG. 5) for further containing the liquid 20 within the puddle area 100 of the second application station 42.

Figure 3:
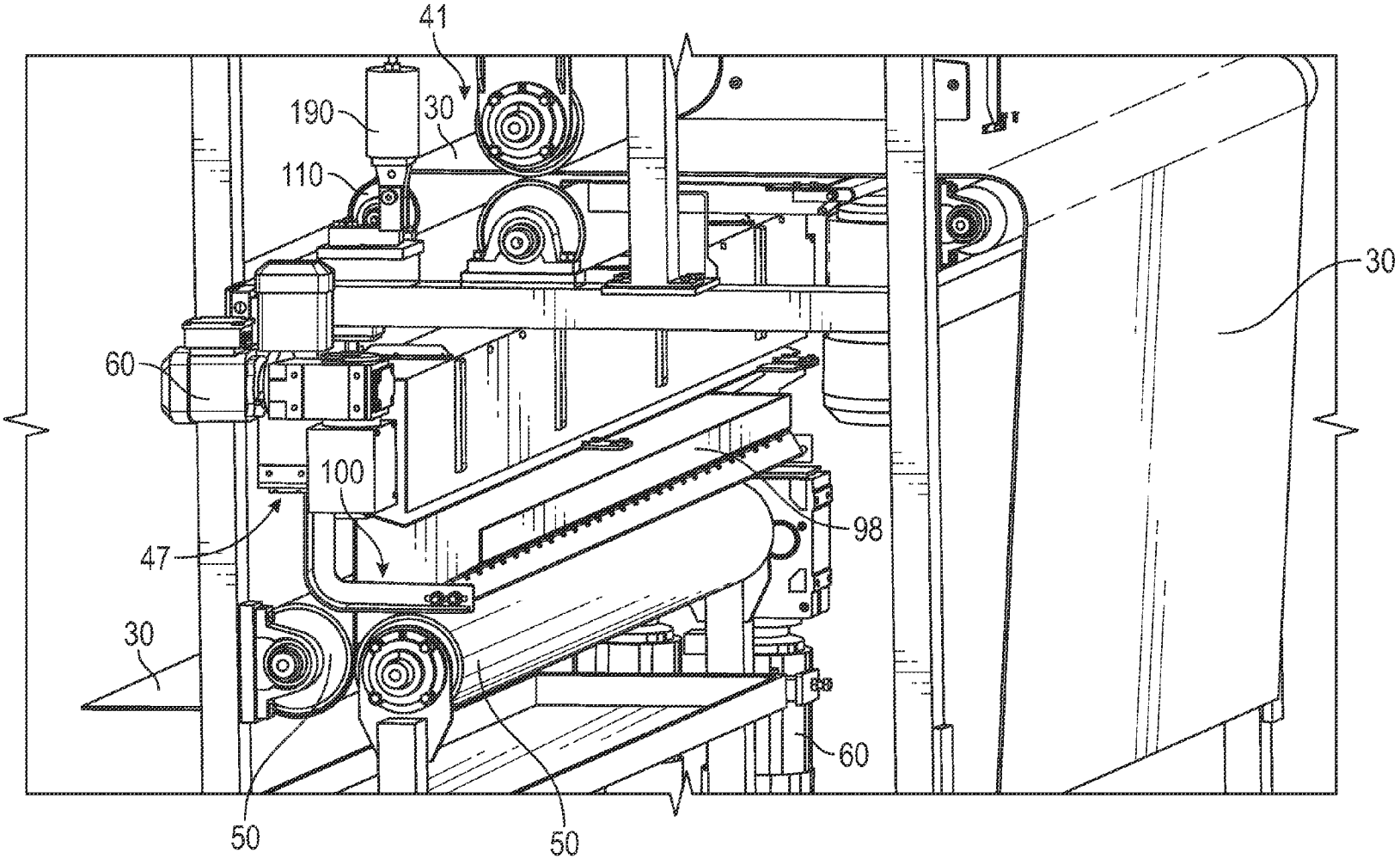
FIG. 3 is a partial perspective view of a pair of application stations separated by a turning roller of the invention.

A turning roller 110 is situated between each of the application stations 40 (FIG. 3). A rigid frame 120 fixes a first application station 41 in a substantially horizontal orientation, and a second 42 of the application stations 40 in a substantially vertical orientation. The turning roller 10 is generally above the second application station 42 and to the rear of the first application station 41. The frame 120 further includes at least a base 130 for supporting the application device 10 on a ground surface 15.

Each top roller 58 is preferably mounted to the frame 120 with a pneumatic cylinder 190 (FIG. 4) controlled by a load cell 200 that detects pressure between the web 30 and the top roller 58. As such, a precise pressure may be applied to the web 30 by the rollers 50. Further, each top roller 58 may be mounted to the frame 120 with a pivot bar 210 pivotally fixed at one end 212 with the frame 120 and at a second end 218 with the pneumatic cylinder 190.

The rollers 50 of the second application station 42 may be set to rotate more quickly than the rollers 50 of the first application station 41, such that the liquid 20 on the top side 31 of the web 30 is forced deeper into the web 30, particularly when the web 30 is carpet or nonwoven fibers, when passing through the second application station 42 and rollers 50 thereof.

As such, the flexible web 30 enters the first application station 41 to receive one of the at least one liquids 20 applied thereto on the first side 31 thereof, turns substantially 90-degrees at the turning roller 110, and enters the second application station 42 to optionally receive one of the at least one liquid 20 applied to a second side 32 thereof.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. An applicator device for applying at least one liquid to a first side of a flexible web, comprising:

a pair of application stations each comprising a pair of parallel rollers adapted to receive the flexible web between an adjustable separation space therebetween, each roller driven by a roller motor arrangement, a platen fixed adjacent to an inlet side of the pair of rollers situated to direct the web between the rollers, a pair of dams each laterally adjustable with respect to a first roller of the pair of rollers and adapted to conform to the shape of the first roller at a forward end thereof, each of the dams, the first roller and the web defining a puddle area to which one of the at least one liquid is applied for application to the web as the web moves between the pair of rollers;

a turning roller situated between each application station;

a frame for fixing a first of the application stations in a substantially horizontal orientation, a second of the application stations in a substantially vertical orientation, and the turning roller generally above the second application station and to the rear of the first application station, the frame further including a base for supporting the applicator device on a ground surface;

whereby the flexible web enters the first application station to receive one of the at least one liquid applied thereto on the first side thereof, turns substantially 90-degrees at the turning roller, and enters the second application station to receive one of the at least one liquid applied to a second side thereof.

2. The applicator device of claim 1 wherein each roller is substantially hollow and adapted to receiving a cooling fluid therethrough from an inlet port on a first end thereof to an outlet port on a second end thereof, whereby each roller resists adhesion of the at least one liquid thereto.

3. The application device of claim 1 wherein each dam of each pair of dams further includes an automated lateral position adjustment mechanism that includes a web edge sensor that provides positioning information to a motorized position adjustment mechanism for adjusting each dam, whereby the dam is automatically positioned proximate one of the edges of the web.

4. The application device of claim 1 wherein each first roller is mounted to the frame with a pneumatic cylinder controlled by a load cell that detects pressure between the web and the first roller, such that a precise pressure is applied to the web by the rollers.

5. The application device of claim 4 wherein each first roller is mounted to the frame with a pivot bar pivotally fixed at one end with the frame and at a second end with the pneumatic cylinder.

6. The application device of claim 1 wherein the rollers of the second of the pair of application stations rotate more quickly than the rollers of the first of the pair of application stations, whereby the liquid on the surface of the web is forced deeper into the web when passing through the second application station than the first application station.

* * * * *